United States Patent [19]

Gelbard et al.

[11] 4,211,090

[45] Jul. 8, 1980

[54] HOUSEHOLD REFRIGERATOR WITH AIR CIRCULATION AND COOLING ARRANGEMENT

[75] Inventors: Robert B. Gelbard; James R. Griffin, both of Louisville, Ky.

[73] Assignee: General Electric Company, Louisville, Ky.

[21] Appl. No.: 966,911

[22] Filed: Dec. 6, 1978

[51] Int. Cl.[2] ..... F25B 5/00; F25D 21/06; F25D 11/02

[52] U.S. Cl. ..... 62/283; 62/276; 62/441

[58] Field of Search ..... 62/275, 283, 441, 276

[56] References Cited

U.S. PATENT DOCUMENTS

| | | | |
|---|---|---|---|
| 1,727,946 | 9/1929 | Spreen | 62/283 |
| 1,985,138 | 12/1934 | Banta | 62/283 |
| 1,996,870 | 4/1935 | Kratky et al. | 62/283 |
| 3,050,956 | 8/1962 | Mann et al. | 62/283 |
| 3,111,817 | 11/1963 | Solley, Jr. | 62/283 |
| 3,116,615 | 1/1964 | Harle | 62/283 |
| 3,381,494 | 5/1968 | Steelman | 62/283 |
| 3,834,176 | 9/1974 | Clarke | 62/276 |
| 3,893,307 | 7/1975 | Jacobs | 62/150 |
| 4,077,229 | 3/1978 | Gelbard et al. | 62/283 |

*Primary Examiner*—Lloyd L. King
*Attorney, Agent, or Firm*—Frank P. Giacalone; Frederick P. Weidner

[57] ABSTRACT

The present invention relates to an air circulating and cooling arrangement for a refrigerator cabinet including a fresh food and freezer storage compartment. A partition dividing the compartments includes a first wall defining the upper wall of fresh food compartment and a second wall defining the lower wall of the freezer compartment. A divider element arranged intermediate the partition walls separates a first passage for circulating air through the fresh food compartment and a second passage for circulating air through the freezer compartment. The evaporator is in heat exchange relation with a portion of the first passage so that air moving through the fresh food compartment contacts colder portions of the divider to remove moisture therefrom prior to passing through the evaporator. The heat leakage from that portion of the divider in heat exchange relation with the evaporator conductively links the evaporator to the fresh food compartment. In effect the present invention links the evaporator to the fresh food compartment conductively as well as convectively.

5 Claims, 3 Drawing Figures

There is defined a first passage that is arranged between the second wall portion and the divider, and a second passage that is arranged between the first wall portion and the divider.

A fan in the chamber is provided for circulating air over the evaporator and through the compartments. Air is directed from the first compartment to the second passage past the portion of the divider in heat exchange relationship with the evaporator and thereafter over the evaporator, whereby moisture is removed from the air as it scrubs against the colder divider portion in heat exchange relationship with the evaporator.

DESCRIPTION OF THE PREFERRED EMBODIMENT

Figure 1:
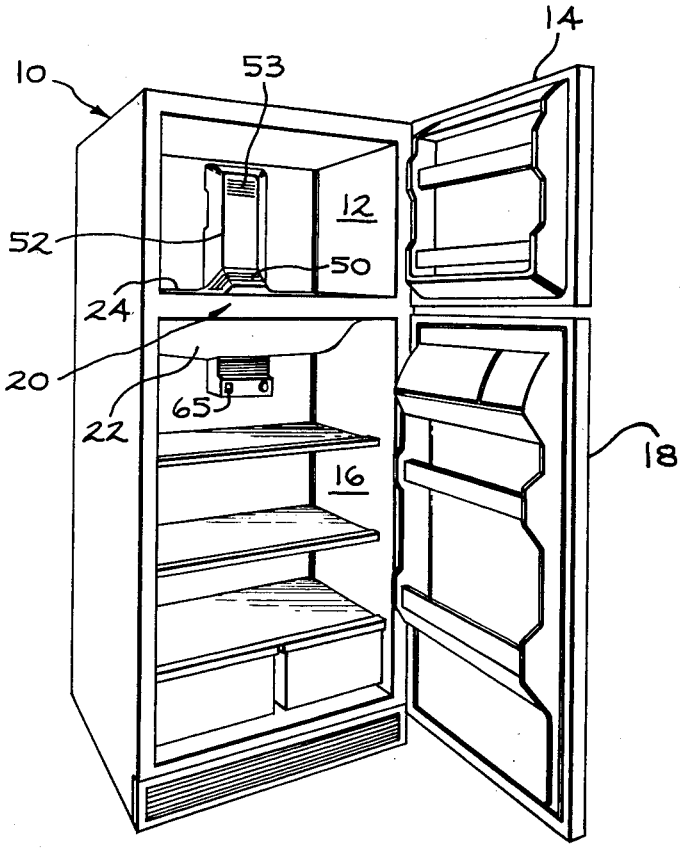
FIG. 1 is a perspective view of a refrigerator incorporating the present invention.
Figure 2:
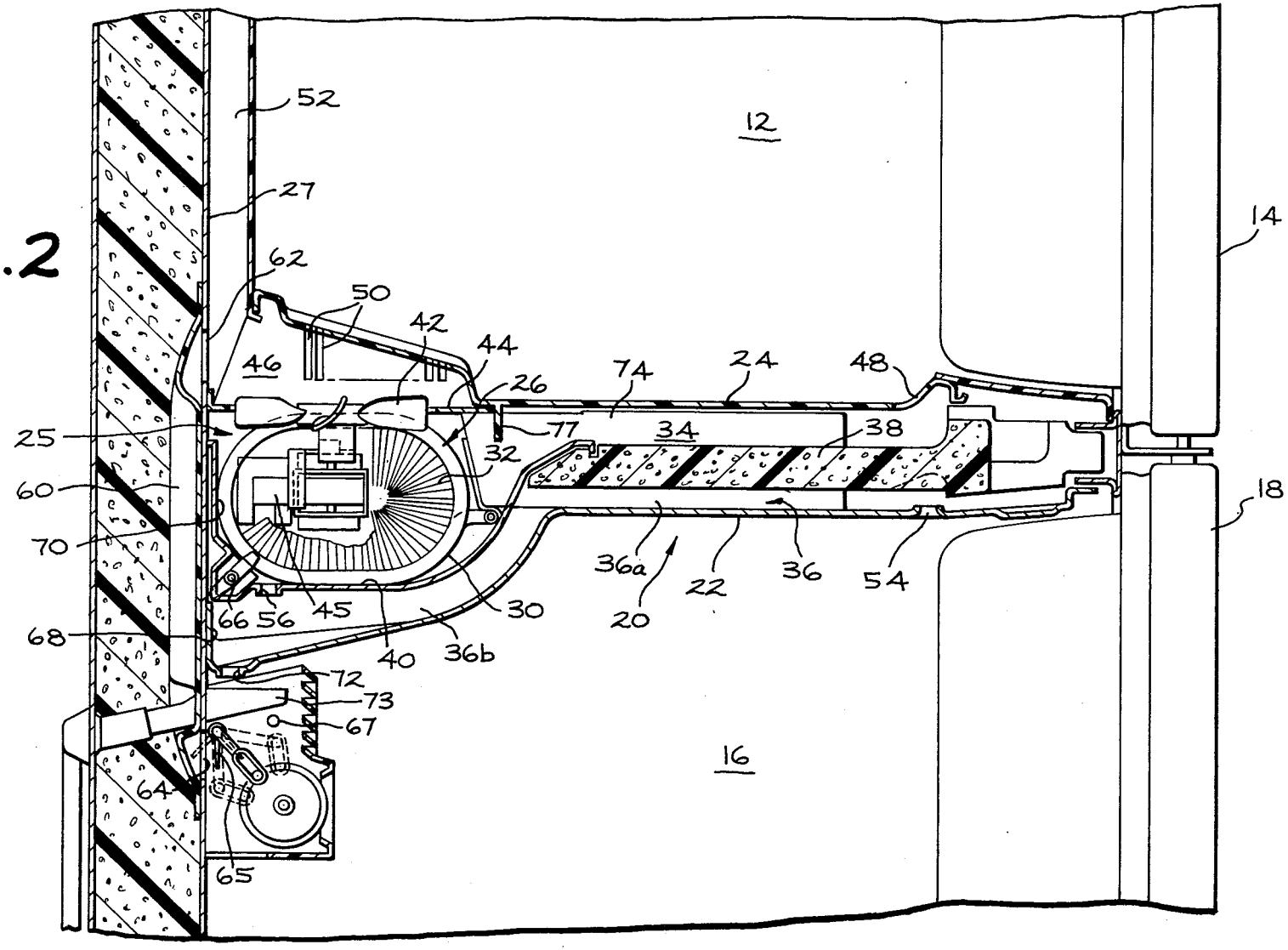
FIG. 2 is a side vertical sectional view showing in detail the construction of the partition incorporating the present invention.
Figure 3:
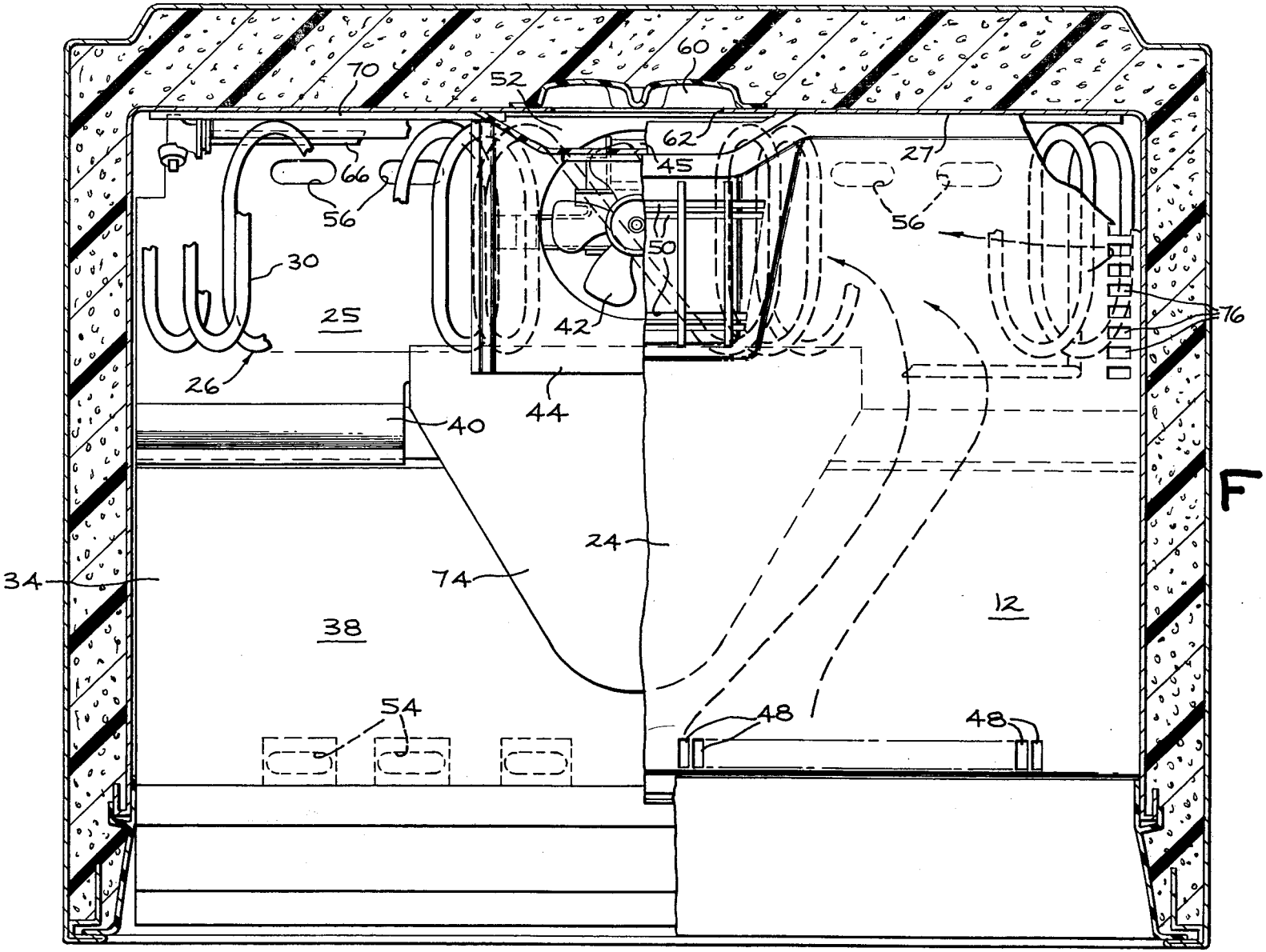
FIG. 3 is a plan view of the partition with parts broken away to show further details.

Referring now to the drawings and more particularly FIG. 1 there is shown a refrigerator cabinet 10 having an upper below-freezing compartment 12 provided with a door 14 and a lower above-freezing compartment 16 provided with a door 18. The compartments 12 and 16 are divided by a partition designated generally by the number 20. The partition includes spaced apart walls that in effect define the upper wall portion 22 of compartment 16 and the lower wall portion 24 of compartment 12. The partition 20 as best seen in FIGS. 2 and 3 includes an area or chamber 25 arranged between walls 22 and 24 in the rear portion of partition 20 adjacent the inner rear wall 27 of the cabinet 10.

In order to provide cooling for both compartments an evaporator 26, designated generally by the numeral 26 is arranged in the chamber 25. To insure that the cooling surface of the evaporator 26 is sufficient for optimum cooling of the air flowing thereover, the evaporator 26 includes a plurality of coils of tubing 30 and a plurality of heat exchanger fins 32 extending inwardly from the tubing 30 substantially to the center of the coils.

In order to provide cooling for both compartments 12 and 16 provision is made for distributing the air cooled by the evaporator 26 to the two compartments in a desired proportion and for returning the air from the compartments to the evaporator. In the form of the invention illustrated, the desired proportion of air is directed through passageways 34 and 36 by a fan 42 to and from compartments 12 and 16 respectively. The passageways 34 and 36 are separated by an insulating divider or element 38 which is arranged intermediate the walls 22 and 24 and extends from the front portion of the partition 20 to outlets communicating with the chamber 25. A plate or heat exchanger element 40 is arranged to extend from the rearward end of divider 38 to a position forming the lower wall of chamber 25. The evaporator 26 as will be explained hereinafter is supported on and is in heat exchange with the plate 40 as shown in FIG. 2. Plate 40 is spaced from the wall 22 so that the passageway 36 in effect includes a first portion **36*a* between the divider 38 and a second portion 36*b* located between the plate 40 which is in heat exchange relationship with the evaporator 26 and wall 22. Passageway 34 is defined between the divider 38 and the wall 24**.

Means are provided for circulating the cooled air over the evaporator 26, from the compartments 12 and 16 through their respective passageways 34 and 36. This circulation of air is affected by the fan 42 which is positioned in a plate 44 which defines the upper wall of the chamber 25. The fan motor 45 is arranged between extended portions of coils substantially in the center of the evaporator 26 as shown in FIG. 3. In effect the evaporator 26 is divided in two portions with the fan and specifically the motor 45 arranged therebetween. The fan 42 is positioned in the plate 44 so as to communicate with an outlet area 46 defined between the wall portion 24 and plate 44.

Air from the compartment 12 circulated by fan 42 enters passageway 34 through an inlet opening 48 in wall 24 in the front portion of compartment 12. Air entering opening 48 passes through passageway 34 and into chamber 25 where it is cooled by evaporator 26 and into outlet area 46 where a portion of the air is then recirculated into compartment 12 through opening 50 in the rear portion of wall 24. Some of the air from area 46 is directed into a duct 52 which has an outlet opening 53 arranged to deliver the cooled air to the upper portion of compartment 12 to better distribute the cooled air therethrough.

Air from the compartment 16 circulated by fan 42 enters passageway 36 through an inlet opening 54 in wall 22 in the front portion of compartment 16. Air entering opening 54 passes through portions **36*a* and 36*b* of passageway 36 and into chamber 25 through an opening 56 in plate 40. Cooled air from compartment 16 passing through the evaporator 26 in chamber 25 then returns to compartment 16 through a passageway 60. The passageway 60 has an inlet 62 arranged in area 46 and an outlet 64 arranged in compartment 16. A portion of air flowing through evaporator 26 is directed by fan 42 into inlet 62 of passage 60 and re-enters compartment 16 through outlet 64. The temperature of the compartment 12 is controlled by a manually-controlled damper 65 arranged in the outlet 64 of passageway 60. By adjusting the position of the damper 65 the user can cause a greater or lesser amount of air to be directed around the temperature sensing element 67 and into compartment 16. The air directed around the temperature sensing element 67 affects the compressor run time thereby controlling the temperature of compartment 12**.

In the operation of refrigerators of this type, wherein the air fan cooling the above-freezing and below-freezing compartments is cooled by causing it to flow over an evaporator located outside the compartments, frost is caused to deposit on the evaporator from the moisture in the air and particularly moisture in the air being returned from the above-freezing compartment 16. Such frost, as it accumulates, reduces the cooling efficiency of the evaporator and hence the efficiency of the refrigerator in two ways. The frost depositing on the evaporator coils provides an insulating cooling which retards heat transfer. Secondly, since the evaporator occupies a substantial portion of the cross sectional area of chamber 25, the accumulation of frost reduces the air flow further decreasing the cooling efficiency of the evaporator.

In order to maintain the refrigerator at a desirable level of operating efficiency, it is necessary from time to time to remove the frost from the evaporator. This may be accomplished in a number of ways, for example, by

HOUSEHOLD REFRIGERATOR WITH AIR CIRCULATION AND COOLING ARRANGEMENT

BACKGROUND OF THE INVENTION

1. Field of the Invention

This invention relates to household refrigerators of the type in which an above-freezing and a below-freezing storage compartment are cooled by an evaporator positioned outside the compartments and more particularly with the arrangement for linking the evaporator conductively as well as convectively to the below-freezing and fresh food compartment.

2. Description of the Prior Art

Many present day household refrigerators include a compartment maintained at a below-freezing temperature for the storage of frozen foods and a second compartment maintained at an above-freezing temperature for storage of fresh foods. In many such refrigerators, an evaporator for providing cooling for both the frozen food compartment and the fresh food compartment is positioned outside both compartments and air is circulated over the evaporator and then through the compartments to provide for cooling thereof. The evaporator itself is maintained at a temperature substantially below freezing. In order to maintain the greatly differing temperatures required in the two compartments, a substantially greater portion of the air flowing over the evaporator is directed to the frozen compartment than to the fresh food compartment. For example, approximately 90% of the air may be directed to the frozen food compartment.

Much more frequent access is usually required to the fresh food compartment than to the frozen food compartment. Particularly, in warm and humid weather, such frequent door opening causes entry into the fresh food compartment of air having a substantial amount of moisture therein. When this air is circulated over the evaporator, which may be at a temperature of −5° F., for example, the moisture in the air is deposited as frost on the evaporator. This deposition of frost on the evaporator has two adverse effects on the efficient operation of the refrigerating system. First, the frost, by providing an insulating coating over the evaporator, reduces the heat transfer thereby decreasing the cooling effectiveness of the evaporator. Secondly, in a refrigerator of the type here under consideration, when the evaporator is positioned in a confined passage and air is circulated over the evaporator and then to the storage compartments, the build-up of frost progressively restricts the space for flow of air through the passage and thereby further decreases the effectiveness of the refrigerating system.

A number of arrangements have been proposed in the prior art for reducing the rate of accumulation of frost on the evaporator employed in refrigerators of this type in an effort to reduce or solve the above problems. In several of these arrangements, an auxiliary evaporator is provided upstream of the evaporator so that the moist circulating air first comes in contact with the auxiliary evaporator and deposits moisture thereon, thereby reducing the amount of frost accumulation on the main evaporator. In some such arrangements, the frost on the auxiliary evaporator may be removed without at the same time defrosting the main evaporator.

In other prior art arrangements, a single evaporator is employed but formed in two sections, the first of which has spaced fins spaced relatively widely and the second of which has fins spaced more closely together. In such arrangements, the air returning from the fresh food compartment is first caused to flow over the first section and then over the second section of the evaporator. Since the air first strikes the first section, the frost tends to deposit more heavily thereon and since the spacing between the fins is greater, the frost has a lesser effect in blocking flow of circulating air over the evaporator.

In another prior art arrangement, air returning from the fresh food and frozen food compartments is caused to flow through two adjacent passages arranged in heat exchange relationship. This causes a reduction in the temperature of the air returning from the fresh food compartment and causes the moisture therein to be deposited in one of the passages before reaching the evaporator, thereby reducing the amount of frost forming on the evaporator. The frost depositing in this passage is later removed by defrosting.

In still another prior art arrangement, the evaporator is mounted in heat exchange relationship to a plate. The evaporator and plate are arranged in one passage. A second passage is arranged adjacent the opposite side of the plate. Moist air returning from the fresh food compartment is caused to circulate through the second passage in contact with the plate so that moisture in this air deposits on the plate as frost before the air reaches the first passage and the cooling element.

In accordance with the present invention, a construction is provided which reduces the amount of frost forming on the evaporator, and which accomplishes this result in a simpler and more effective manner and with advantages not present in the prior art type arrangement discussed above.

Accordingly, it is an object of this invention to provide a two-temperature, two-compartment refrigerator including an improved arrangement for air circulation.

It is another object of this invention to provide in a refrigerator of this type an improved air circulation and frost deposition arrangement which significantly reduces the amount of frost deposited on the evaporator and materially reduces interference with the circulation of air.

It is an object of this invention to provide an arrangement whereby the evaporator is linked conductively, as well as convectively, to the fresh food compartment.

SUMMARY OF THE INVENTION

In carrying out the objects of this invention, in one form thereof a conventional refrigerator cabinet is employed including a first food storage compartment to be maintained at a temperature above freezing and a second food storage compartment to be maintained at a temperature below freezing. A partition dividing the compartments includes the air circulating and cooling arrangement of the present invention.

The partition includes a first wall portion defining the upper wall of the first compartment, and a second wall portion defining the lower wall portion of the second compartment. A divider element is arranged in the partition intermediate and spaced from the first and second wall portions. A chamber located in the rear portion of the partition is arranged intermediate to the second wall and the divider with a portion of the divider underlying the chamber defining the lower wall thereof. Located in the chamber is an evaporator that is arranged in heat exchange relationship with the portion of the divider forming the lower wall of the chamber.

providing an electric heating element which is energized at intervals to melt the frost. A suitable electric heating element 66 for this purpose is shown extending transversely of the chamber 25 near the lower rear corner thereof. It is impossible, of course to cause all of the heat from the electric heater to be confined totally to melting frost. A substantial amount of the heat is directed to portions of the refrigerator other than the frost thereby raising the temperature of the contents in the compartments 12 and 16 and reducing the efficiency of the refrigerator. It is, therefore, desirable that the length of time between defrosting operation be extended as long as reasonably possible and that the heater be operated for as short a time as possible in accomplishing the defrosting operation.

In accordance with the present invention these desirable objectives are achieved by reducing the amount of frost deposited on the evaporator 26 and causing it to preferentially deposit in an area where it will have lesser effect on the circulation of air and on the efficiency of operation of the refrigerator. For this purpose the refrigerator and more particularly the partition is constructed so that the passage 36 as mentioned above extends adjacent the colder plate 40.

Due to the insulating divider 38 and the returning fresh food air, the front portion of wall 22 in the portion **36*a* of passage 36 is generally above the dew point of compartment 16. The portion 36*b* of the passage 36 arranged in heat exchange relationship with the evaporator cooled plate 40 is effective in causing moisture to condense therein thereby dehumidifying the moist warmer air being recirculated from the compartment 16 as a substantial amount of the moisture selectively deposits on the plate 40 rather than the evaporator. At the same time moisture from the compartment 16 also condenses on the rear portion of wall 22 which is conductively linked to the evaporator 26. Provision is also made to drain the accumulated condensation as it forms on plate 40 and to drain the melting frost when the evaporator is defrosted. Water that may drain from the evaporator compartment flows out of the air inlet 56 in plate 40 and through a drain opening 72 in wall 22. Condensate and/or frost that may be present on plate 40 will also flow out of drain opening 72 into a trough 73, where it is carried away by the customary drain system provided in the refrigerator. The passageway 36 accordingly acts both as a means for dehumidifying air recirculating through compartment 16 and as a drain system for water collected in the plate 40 and evaporator. The rear portion of wall 22 is shaped so that moisture condensed thereon will flow into trough 73**.

It should be apparent from the foregoing description that by the present invention the evaporator 26 is linked conductively as well as convectively to the fresh food compartment 16. To this end it will be noted that the air flow driven through the passage 36 by fan 42 convectively links the evaporator 26 to the compartment 16, and due to the heat exchange relationship between the plate 40 and the evaporator 26 because of heat leakage through plate 40 and wall 22 is linked conductively to the compartment 16. It should be noted that the heat leakage between the evaporator and compartment 16 is in the absence of any insulating material in the portion **36*b* of passage 36**.

To maximize the output of the evaporator 26 relative to the power or wattage used the air flow into the compartment 25 is arranged to provide a high degree of scrubbing action as it passes across the evaporator 26. To this end the divider 38 includes diverter portion 74 arranged to block air flow through the central portion of passage 34. The diverter 74 directs air entering inlets 48 towards the separated portions of the evaporator 26 so that air entering the chamber 25 flows in the general direction indicated by the arrows. The air so directed flows around the diverter 74 towards the side walls of the cabinet. This air encounters deflector 77 which directs the air downwardly toward the central portion of the evaporator 26 and then inwardly through the coils to the fan 42. Additional inlets 76 communicating directly into the chamber 25 may be provided adjacent the side walls of the refrigerator cabinet so that a portion of the air returning from compartment 12 is directed inwardly.

In summary by the present invention an air circulating and cooling arrangement is provided that is effective in maintaining the separate food compartments at desired temperatures by linking the evaporator conductively and convectively thereto, while at the same time providing means for removing moisture from the air circulating from the fresh food compartment prior to its passing over the evaporator. This arrangement extends the period of time between energization of the defrost heater since moisture will take longer to form on the evaporator and accordingly resulting in a more energy efficient refrigerator.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. In a refrigerator cabinet including a first food storage compartment to be maintained at a temperature above freezing and a second food storage compartment to be maintained at a temperature below freezing, an air circulating and cooling arrangement comprising:

(a) a partition dividing said compartments including a first wall portion defining the upper wall of said first compartment, and a second wall portion defining the lower wall of said second compartment;

(b) a divider element arranged intermediate said first and second wall portions;

(c) a chamber in the rear portion of said partition intermediate said second wall and said divider;

(d) an evaporator in said chamber mounted in heat exchange relationship with at least a portion of said divider element;

(e) means defining a first passage arranged between said second wall portion and divider;

(f) means defining a second passage arranged between said first wall portion and said divider;

(g) means for circulating air over said evaporator and through said compartments; and (h) means for directing air from said first compartment to said second passage and thereafter over said evaporator in said chamber, whereby moisture is removed from the air recirculating from said first compartment air as it scrubs against said colder divider element portion in heat exchange relationship with said evaporator.

2. The invention recited in claim 1 wherein a second portion of said divider element provides thermal insulation between said first and second passage.

3. The invention recited in claim 2 wherein said first passage extends between an inlet opening in said second wall and said chamber; and said second passage extends between an inlet opening in said first wall and an outlet opening in said divider communicating with said chamber substantially downstream relative to said portion of said divider heat exchange relationship with said evaporator.

4. The invention recited in claim 3 wherein said evaporator includes a first and second portion;

said air circulating means including a fan arranged in an outlet in said chamber and a drive means located between said first and second portion of said evaporator.

5. The invention recited in claim 4 wherein a third passage means extends from an inlet area adjacent said chamber outlet to an outlet in said first chamber for recirculating a portion of said air returning from said first compartment.

* * * * *